US006126462A

United States Patent [19]

Lam

[11] Patent Number: 6,126,462

[45] Date of Patent: Oct. 3, 2000

[54] UNIVERSAL ADAPTER

[76] Inventor: Siu Ling Lam, Flat 8, 15/F., Laurels Industrial Centre, 32 Tai Yau Street, San Po Kong, Kowloon, Hong Kong, The Hong Kong Special Administrative Region of the People's Republic of China

[21] Appl. No.: 09/298,944

[22] Filed: Apr. 26, 1999

[51] Int. Cl.[7] ..... H01R 29/00

[52] U.S. Cl. ..... 439/171; 439/173; 439/269.2

[58] Field of Search ..... 439/171, 173, 439/269.2

[56] References Cited

U.S. PATENT DOCUMENTS

| | | | |
|---|---|---|---|
| 2,277,293 | 3/1942 | Bradford | 439/269.2 |
| 3,159,445 | 12/1964 | Wolk | 439/269.2 |
| 4,305,634 | 12/1981 | Lewis | 439/269.2 X |
| 4,579,410 | 4/1986 | Soloman . | |
| 4,978,318 | 12/1990 | Wiley et al. . | |
| 5,106,317 | 4/1992 | Taylor | 439/173 |
| 5,295,845 | 3/1994 | Changxing | 439/173 |
| 5,716,219 | 2/1998 | Noike . | |

FOREIGN PATENT DOCUMENTS

| | | |
|---|---|---|
| 87207492 U | 5/1988 | China . |
| 90215005 | 5/1991 | China . |
| 89109751 | 7/1991 | China . |
| 92221271 | 4/1993 | China . |
| 92222609 | 5/1993 | China . |
| 96230922 | 12/1997 | China . |
| 0085802A1 | 8/1983 | European Pat. Off. . |
| 4209076A1 | 9/1993 | Germany . |
| 02253578A | 10/1990 | Japan . |
| 07296898A | 11/1995 | Japan . |
| 09147959A | 6/1997 | Japan . |
| WO93/14540 | 7/1993 | WIPO . |

*Primary Examiner*—Stanley J. Witkowski
*Attorney, Agent, or Firm*—Burns, Doane, Swecker & Mathis, L.L.P.

[57] ABSTRACT

A universal adapter including two electrically conductive pins which are electrically connected with an output socket of an adapter body, in which the pins are releasably engageable with an oblong ring for insertion into holes of a wall socket in order to establish electrical contact with the wall socket, in which the pins are movable relative to the ring when the pins are engaged with the ring in order to vary the distance and/or orientation between the pins.

21 Claims, 14 Drawing Sheets

UNIVERSAL ADAPTER

This invention relates to a universal adapter and, in particular, such an adapter which can be used in various countries in the world in which the wall sockets are differently structured.

BACKGROUND OF THE INVENTION

There are now various portable electrical appliances which can be operated by the user during travelling in other countries. Such appliances may include portable computers, mobile phones and facsimile machines. In order to adapt to the differences in the voltage of municipal power supply, many such products are installed with built-in voltage converter, which allows the user to step up or step down the voltage of municipal power supply, as desired.

Another problem associated with the use of such appliances in various countries is that the shape and arrangement of the holes in wall sockets may vary from country to country. There are now four types of wall-socket arrangements in the world. In Great Britain, Hong Kong, Singapore, etc., the wall sockets are of BS type, and include three rectangular holes. In such countries as the US, Canada, Japan and Taiwan, the wall sockets are of UL type, and include two flat holes. In other European countries, the wall sockets are of VDE type, and include two round holes. In Australia and New Zealand, the wall sockets are of SAA type, and include two inclined flat holes.

DESCRIPTION OF THE PRIOR ART

In view of the above situation, various electrical adapters have been devised for allowing the many electrical appliances to be used around the world. For example, U.S. Pat. Nos. 4,579,410, 4,978,318, 5,159,545 and 5,716,219, Japanese Patent Publication Nos. 02253578A, 07296898A, 09147959A, and Chinese Patent Publication Nos. 87207492U, 1053147A, 2078049U, 2132295Y and 2271046Y disclose various plugs and adapters which may be used in conjunction with more than one type of wall socket. However, most such adapters are very bulky, at least when compared with conventional electric plugs or sockets. In additional, a relative high amount of metal is required for making the components in such adapters, which add to the manufacturing cost.

It is thus an object of the present invention to provide a universal adapter in which the aforesaid shortcomings are mitigated, or at least to provide a useful alternative to the public.

SUMMARY OF THE INVENTION

According to the present invention, there is provided a universal adapter comprising at least two electrically conductive pin members electrically connected with output socket means of a body member, wherein said pin members are releasably engageable with coupling means for insertion into holes of a wall socket for establishing electrical contact therewith, characterized in that said pin members are movable relative to said coupling means when said pin members are engaged therewith.

BRIEF DESCRIPTION OF THE DRAWINGS

A preferred embodiment of the present invention will be described by way of an example, and with reference to the accompanying drawings:

FIGS. 13A and 13B show engagement of the pin members with a first type of adapting pin, in which FIG. 13B is a sectional view taken along the line VII—VII in FIG. 13A;

FIGS. 14A and 14B show engagement of the pin members with a second type of adapting pin, in which FIG. 14B is a sectional view taken along the line VIII—VIII in FIG. 14A;

FIGS. 16A to 16C show orientation of the pin members for insertion into a further kind of socket holes, in which FIG. 16C is a sectional view taken along the line IX—IX in FIG. 16A.

DETAILED DESCRIPTION OF THE PREFERRED EMBODIMENTS

Figure 1:
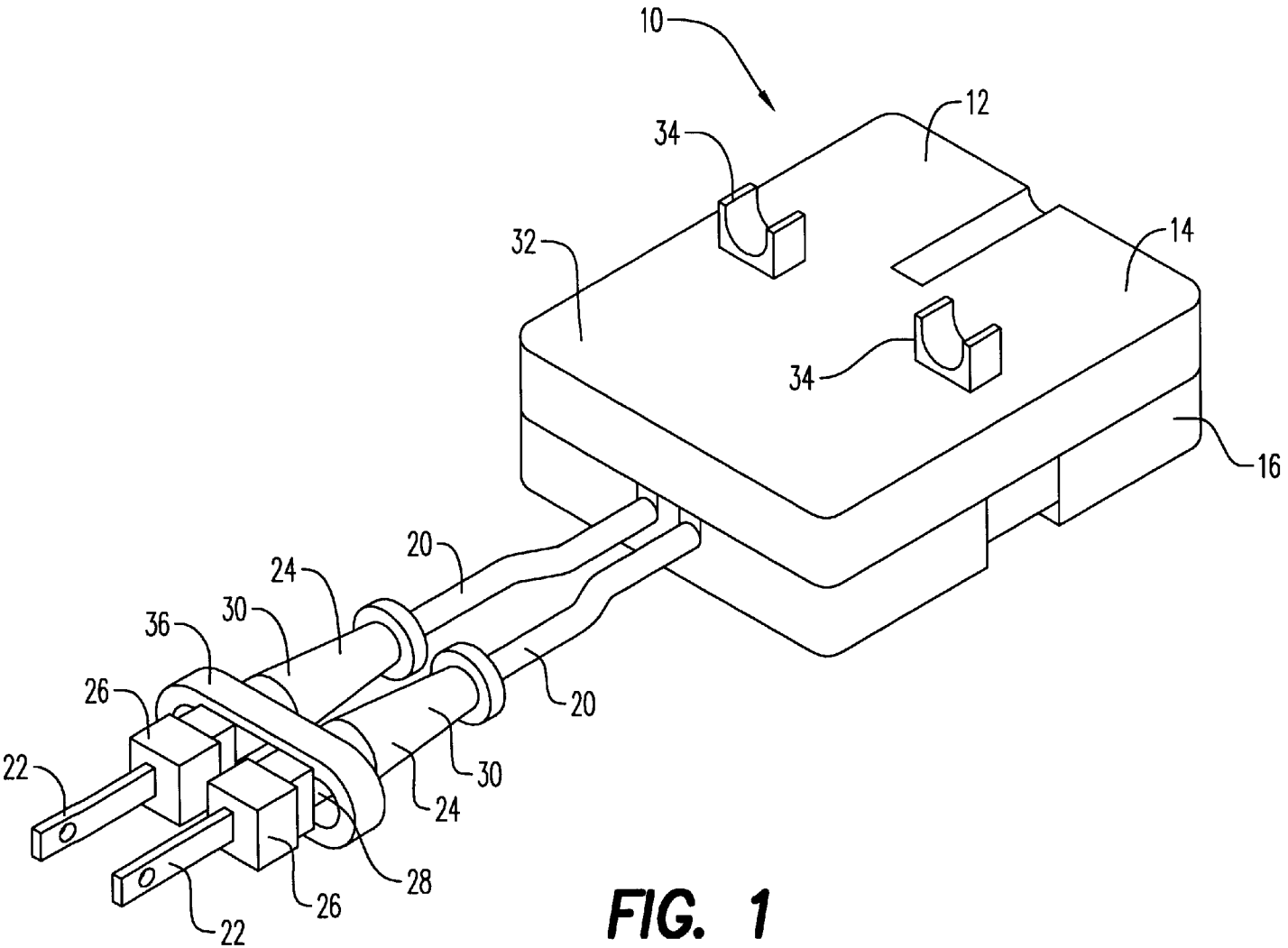
FIG. 1 is a front perspective view of a universal adapter according to the present invention.
Figure 2:
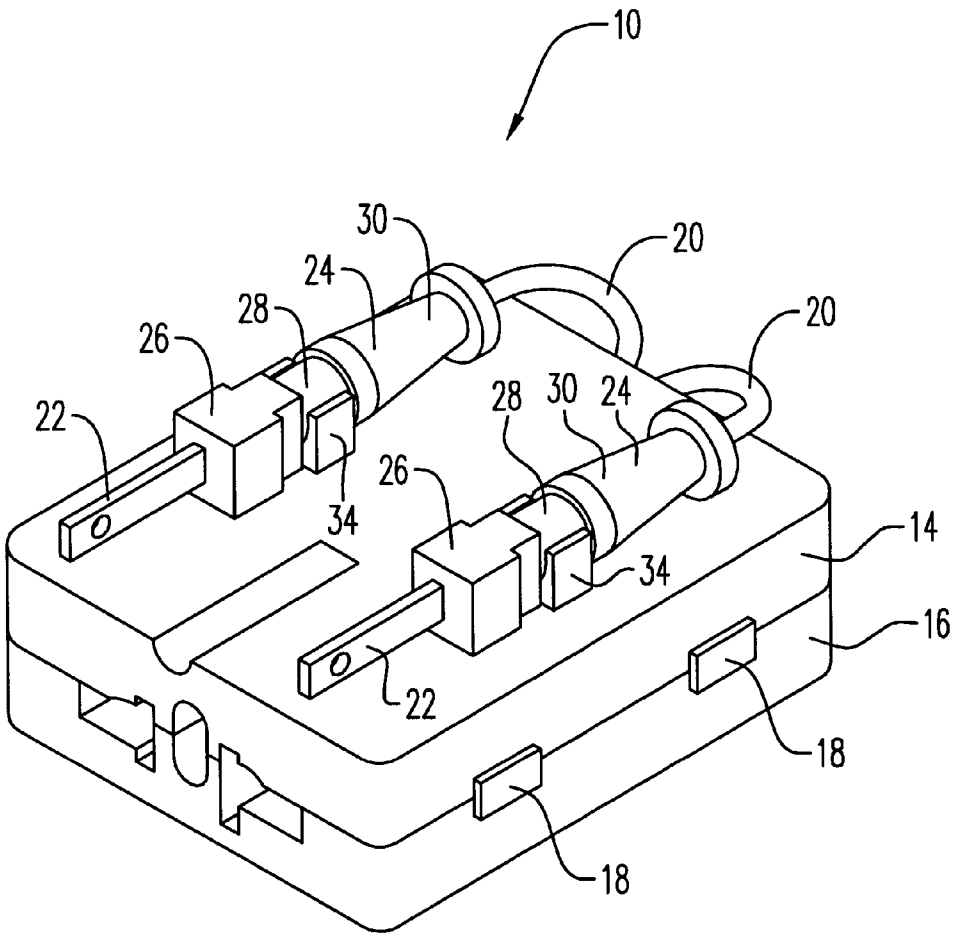
FIG. 2 is a rear perspective view of the adapter shown in FIG. 1.
Figure 10A:
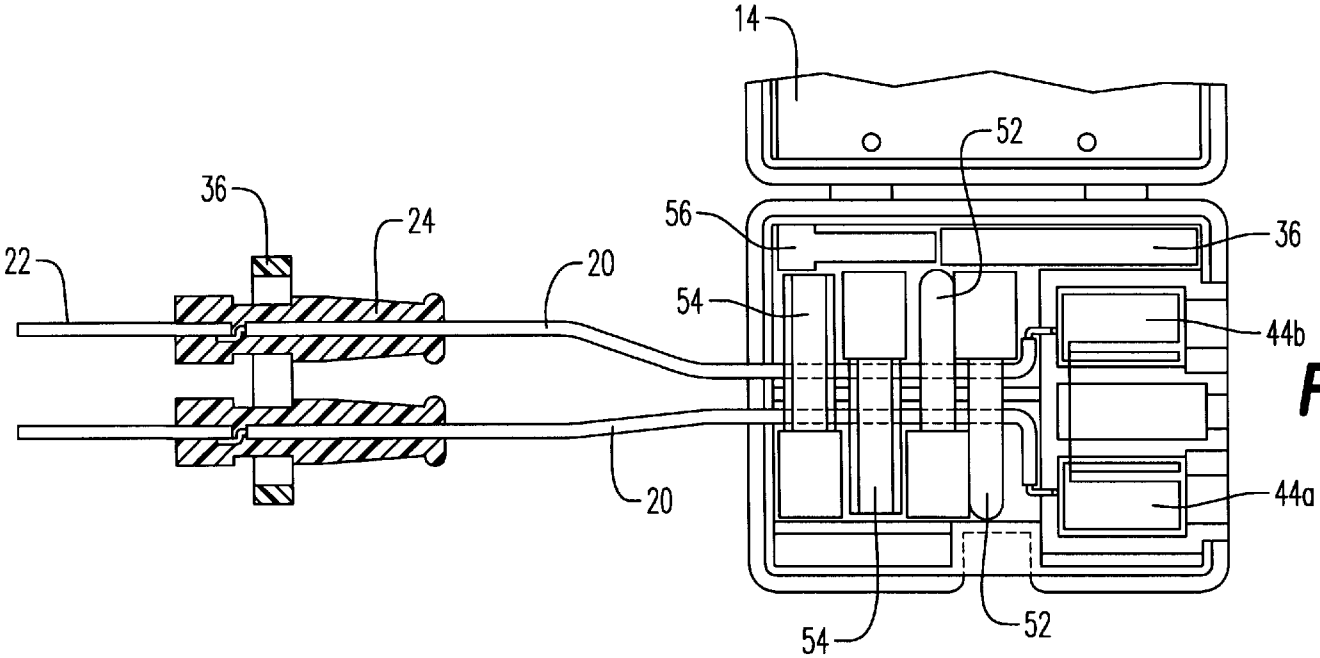
FIG. 10A shows a partial top view of the adapter shown in FIG. 1 in which the body member is in the open position.

As shown in FIGS. 1 and 2, a universal adapter according to the present invention is shown and designated as 10. The adapter 10 includes a body 12 with a top 14 and a base 16. The top 14 and the base 16 are swivellable relative to each other about two hinges 18, so that they may be closed (e.g. as shown in FIGS. 1 and 2) or opened (e.g. as shown in FIG. 10A). Extending out from the interior of the body 12 are two electric wires 20, each electrically connected with an electrically conductive pin 22 which may be inserted into a hole of a socket.

Each pin 22 is fixedly secured to an engagement member 24 with a cube-like portion 26, a narrow cylindrical portion 28 and a frusto-conical portion 30. On the outer major surface 32 of the top 14 are two half-rings 34, each for receiving and engaging the narrow cylindrical portion 28 of a respective engagement member 24. As shown in FIG. 1, the engagement members 24 may be releasably coupled to an oblong ring 36 in a manner to be discussed below. When the engagement members 24 are disengaged from the oblong ring 36, they may be received by the two half-rings 34, as shown in FIG. 2.

Figure 3:
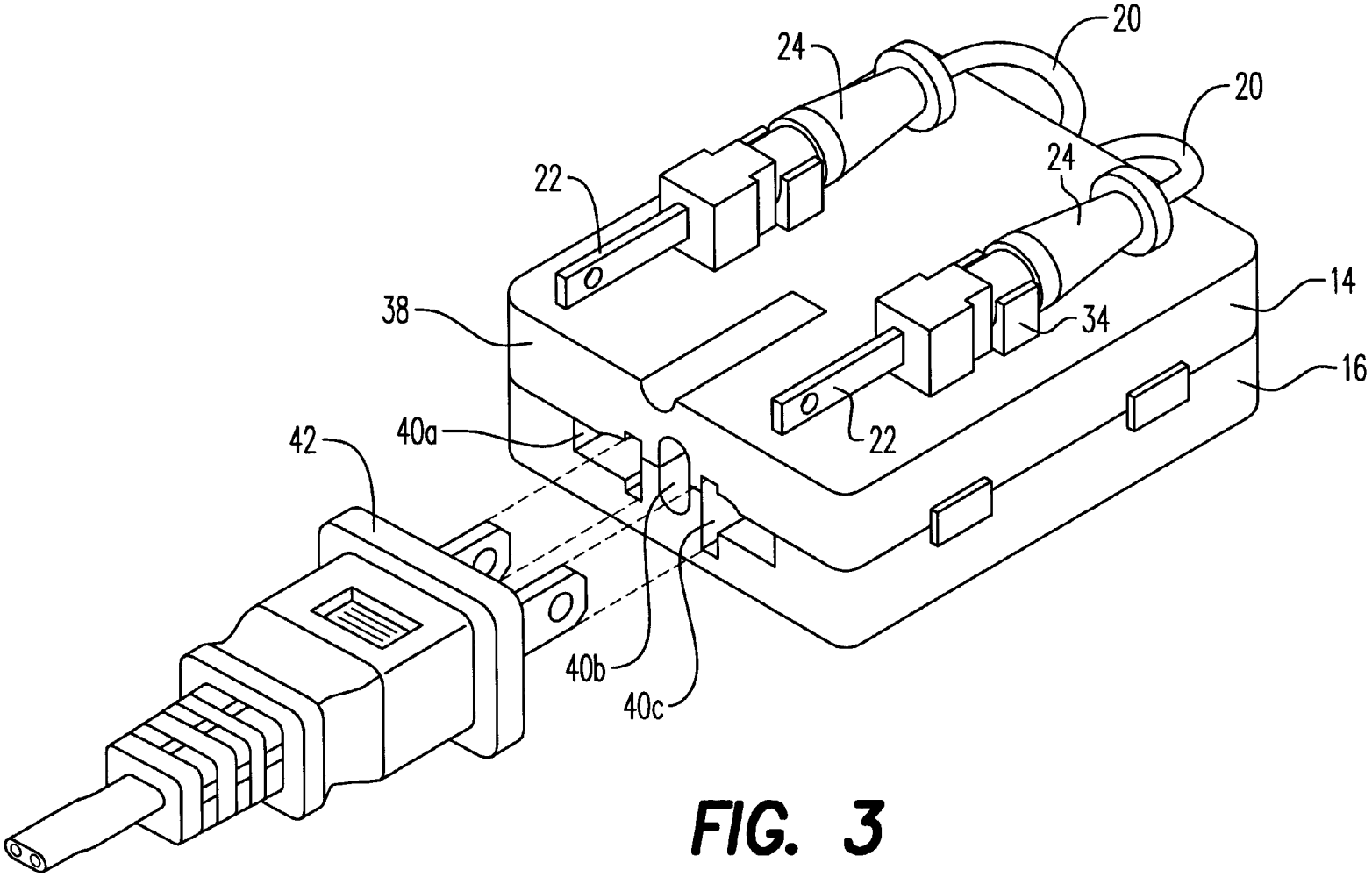
FIG. 3 is a further rear perspective view of the adapter shown in FIG. 1.
Figure 4:
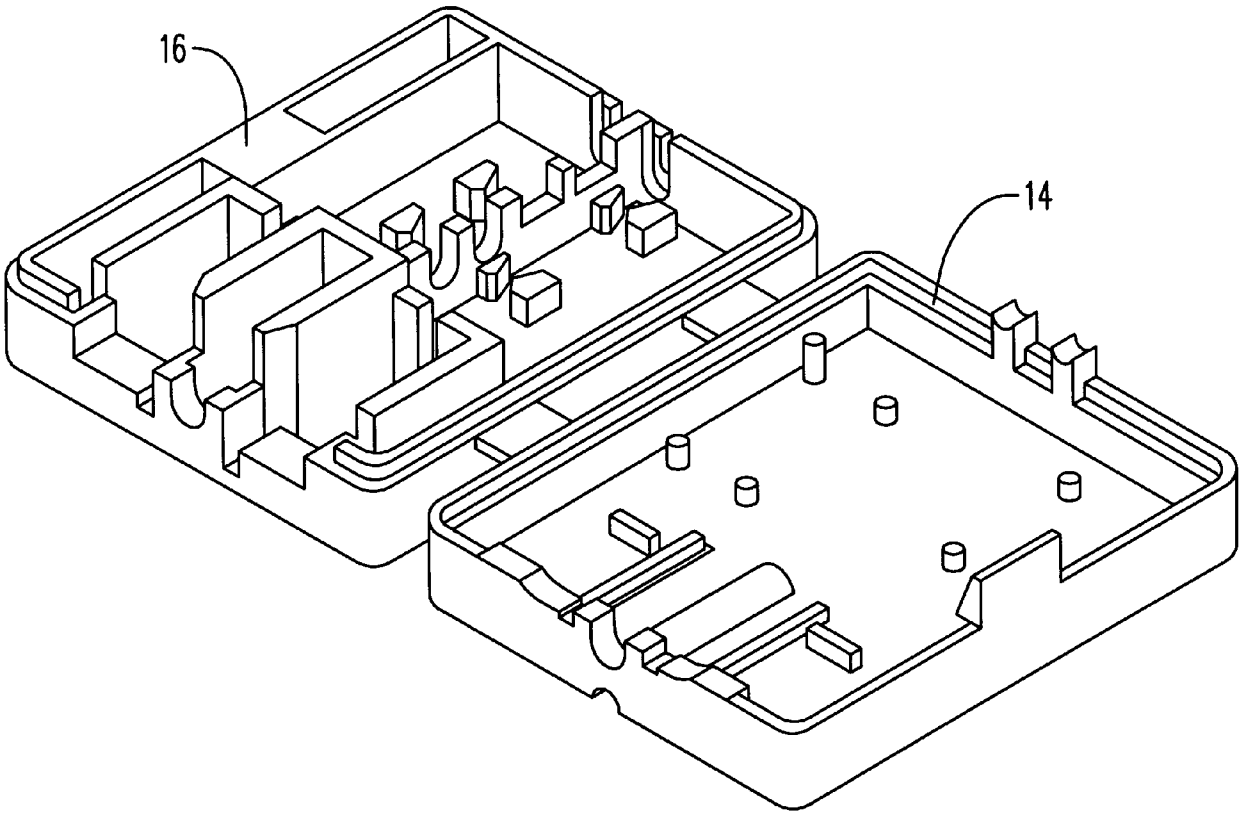
FIG. 4 is a perspective view of the body member of the adapter shown in FIG. 1 in an open position.
Figure 5B:
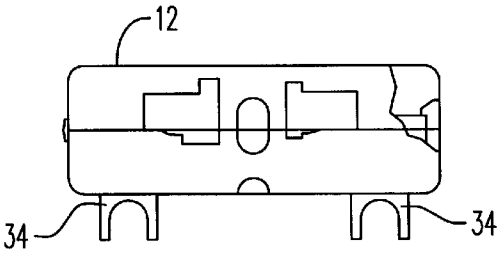
FIG. 5B is a front view of the body member shown in FIG. 4 in a closed position.
Figure 5C:
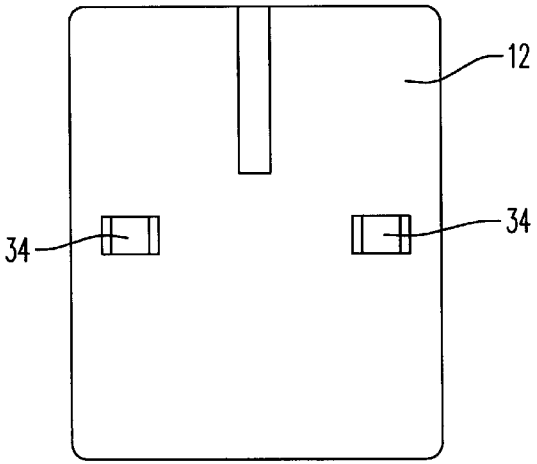
FIG. 5C is an underneath view of the body member shown in FIG. 5B.
Figure 5A:
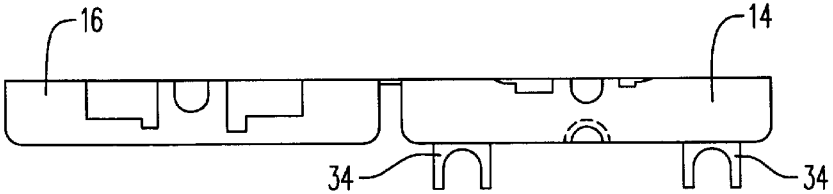
FIG. 5A is a front view of the body member shown in FIG. 4.
Figure 6B:
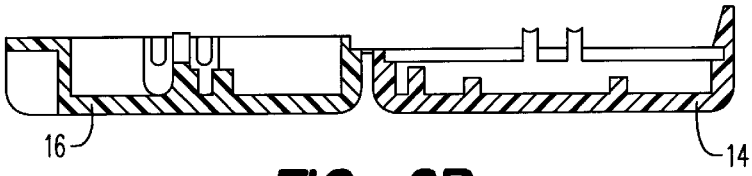
FIG. 6B is a cross-sectional view of the body member shown in FIG. 4 taken along the line I—I.
Figure 6C:
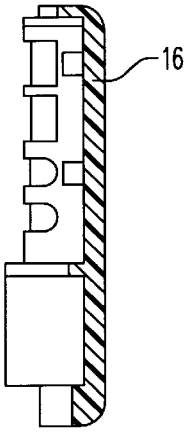
FIG. 6C is a cross-sectional view of the body member shown in FIG. 4 taken along the line II—II.
Figure 6A:
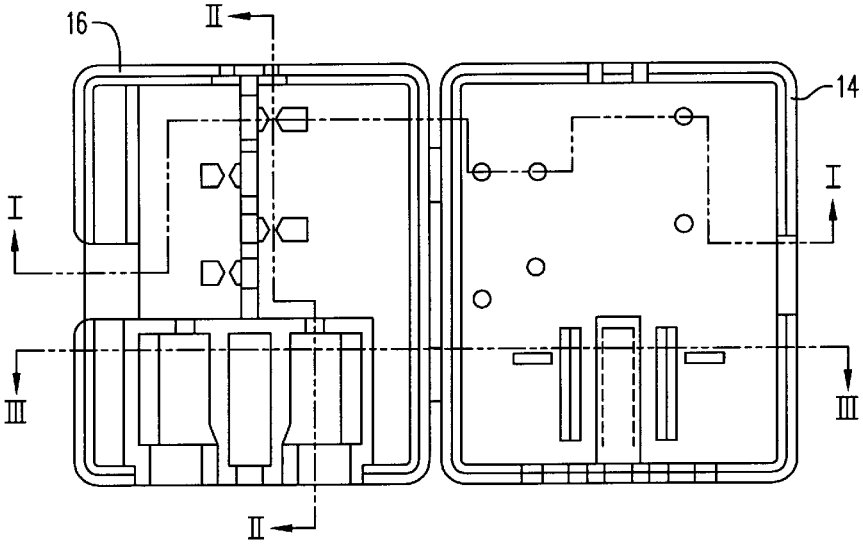
FIG. 6A is a top view of the body member shown in FIG. 4.
Figure 6D:
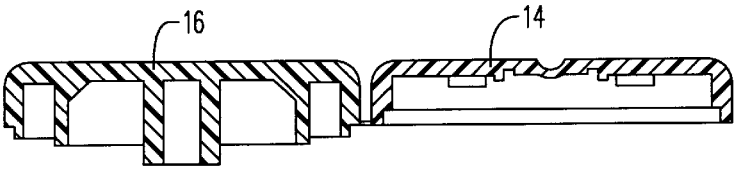
FIG. 6D is a cross-sectional view of the body member shown in FIG. 4 taken along the line III—III.
Figure 7:
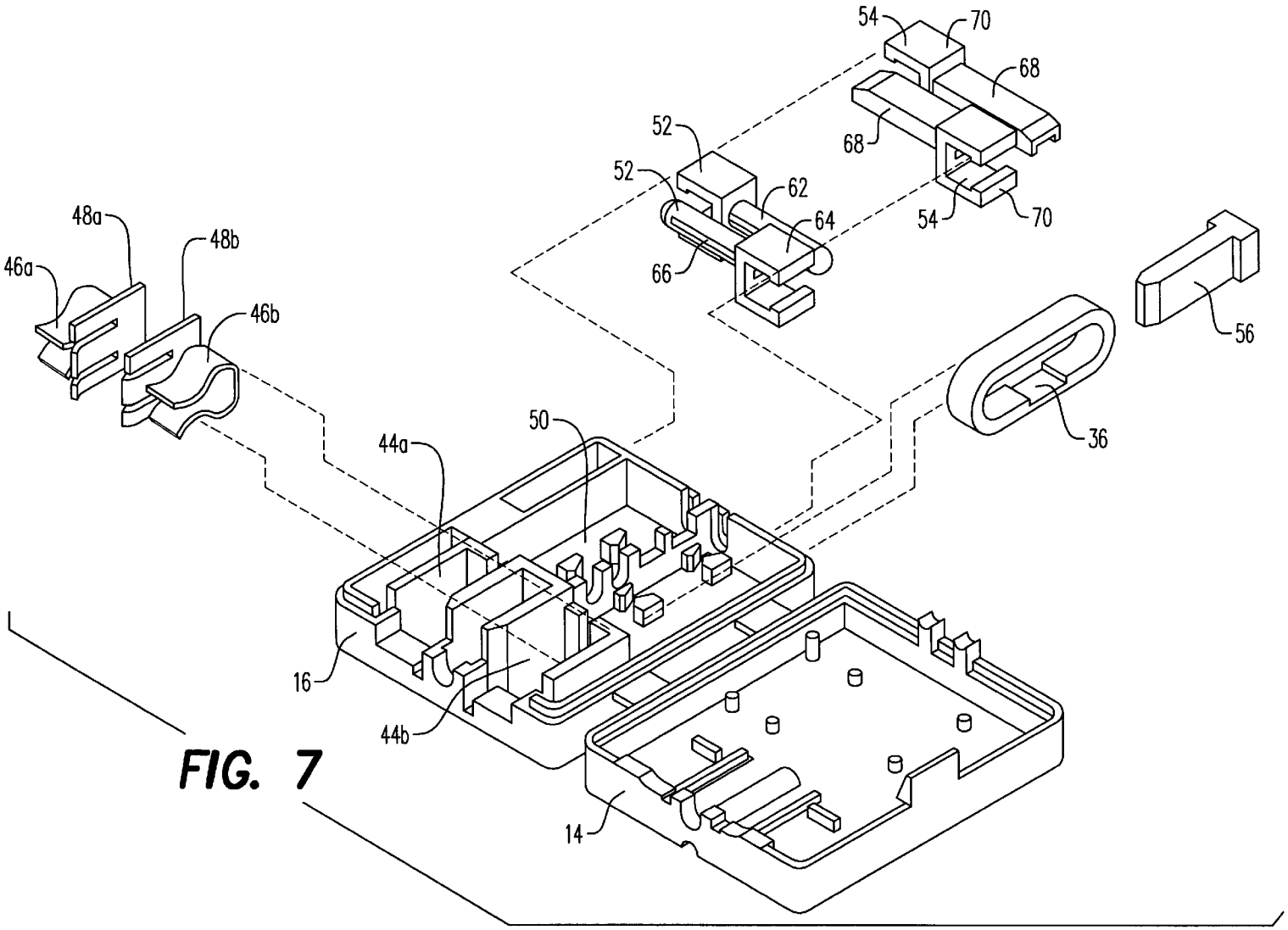
FIG. 7 is a further perspective view of the body member of the adapter shown in FIG. 1 in the open position.

As can be seen in FIGS. 2 and 3, the top 14 and the base 16, when closed, combine to form on an end 38 of the body 12 apertures 40*a*, 40*b* and 40*c*, thus forming a socket, adapted for receiving an electric plug 42 of an electrical appliance (not shown). As shown in FIGS. 4, 5A to 5C and 6A to 6D, the top 14 and the base 16, when open, reveal cavities which may be used for storing various component parts of the adapter 10. In particular, as shown in FIG. 7, the base 16 includes a recess 44*a* for receiving a metal socket clip 46*a* and metal platelet 48*a* assembly, and a recess 44*b* for receiving a metal socket clip 46*b* and metal platelet 48*b* assembly. The socket clip 46*a*, 46*b* and the respective platelet 48*a*, 48*b* are fixedly secured to each other, e.g. by welding or being formed integrally. When assembled, the plug 42 of the electrical appliance may be plugged into the apertures 40*a*, 40*b*, 40*c* for establishing electrical contact with the clips 46*a*, 46*b*. The base 16 also includes a recess 50 for receiving the oblong ring 36, a pair of a first type of adapting pins 52, a pair of a second type of adapting pins 54 and an earth pin 56. While the socket clips 46*a*, 46*b* and the platelets 48*a*, 48*b* are made of an electrically conductive metal, e.g. copper, the ring 36, the adapting pins 52, 54 and the earth pin 56 are all made of an electrically insulating material, e.g. plastics.

Figure 8:
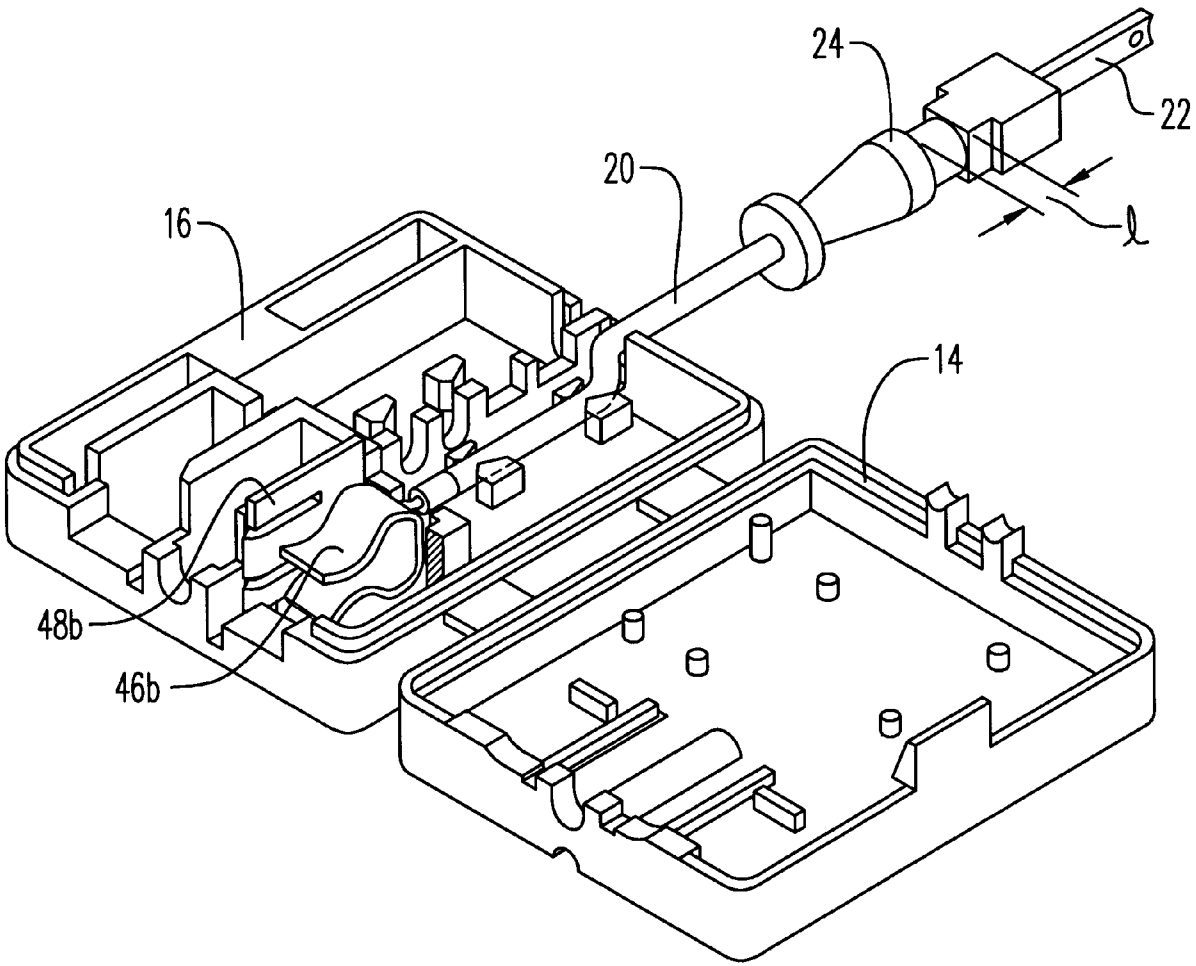
FIG. 8 is a perspective view of the body member of the adapter shown in FIG. 1 in the open position, showing the connection between the pin member and the socket.
Figure 9:
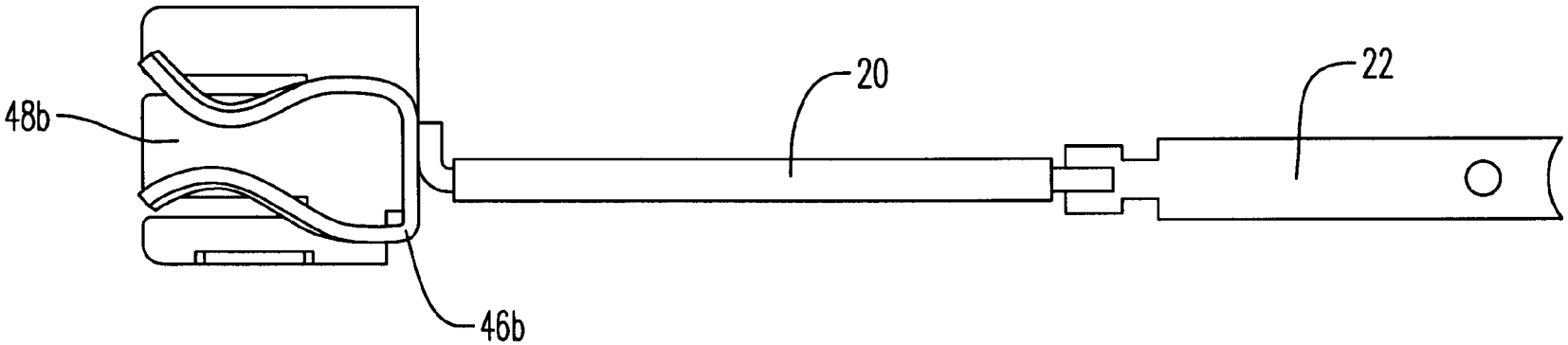
FIG. 9 shows in more detail the connection between the pin member and the socket shown in FIG. 8.

It can be seen from FIGS. 8 and 9 that while one end of the electric wire 20 leads to and is in electrical connection with the pin 22, another end of the electric wire 20 is connected with the platelet 48*b*, which is in contact with the socket clip 46*b*. By way of such an arrangement, when the pins 22 are inserted into holes of a wall socket, an electrical appliance whose plug 42 is plugged into the apertures 40*a*, 40*b*, 40*c* may obtain electric power from the wall socket.

Figure 10B:
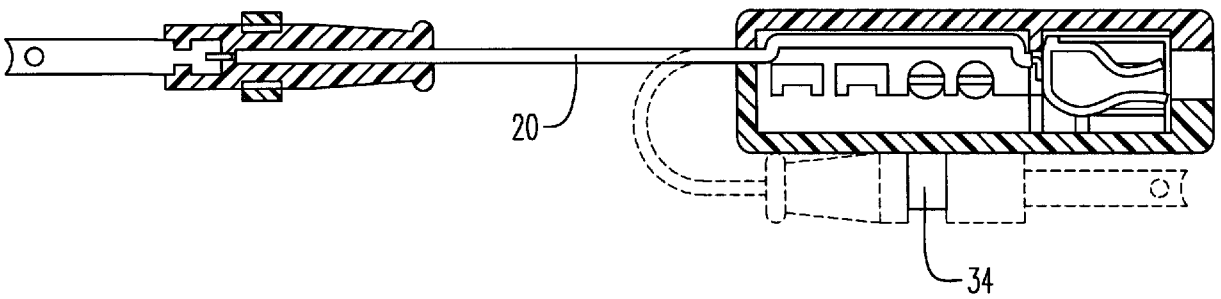
FIG. 10B is a sectional view of the adapter shown in FIG. 10A in which the body member is in the closed position.

FIGS. 10A and 10B show the way the ring 36, the adapting pins 52, 54 and the earth pin 56 are stored in the body 12. It can be seen that such provides a very neat, compact and easily portable adapter arrangement. The arrangement of the pins 22, the engagement members 24 and the ring 36 as shown in these two figures allow the pins 22 to be inserted into wall sockets of the UL type.

Figure 12A:
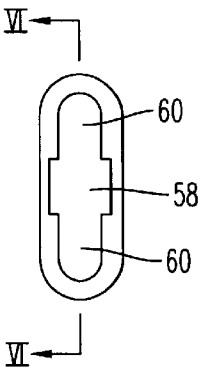
FIG. 12A shows a front view of the coupling means.
Figure 12B:
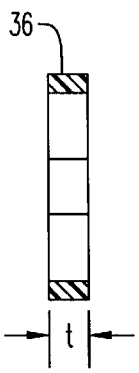
FIG. 12B shows a sectional view of the coupling means shown in FIG. 12A taken along the line VI—VI.
Figure 11A:
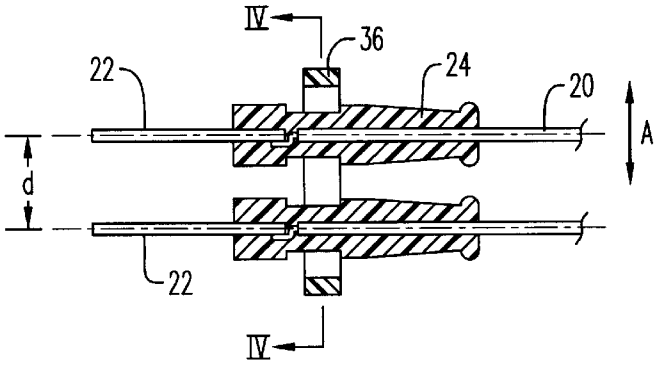
FIG. 11A shows engagement between the pin members and the coupling means.
Figure 11B:
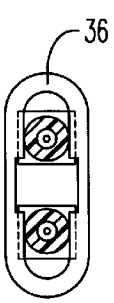
FIG. 11B shows a sectional view taken along the line IV—IV in FIG. 11A.
Figure 11C:
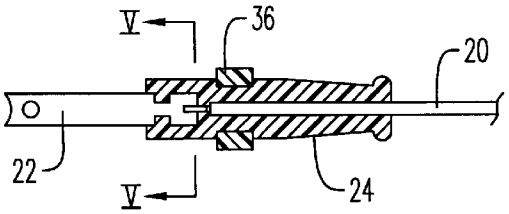
FIG. 11C is a side view of the pin members and coupling means shown in FIG. 11A.
Figure 11D:
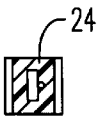
FIG. 11D shows a sectional view taken along the line V—V in FIG. 11C.

It can be seen in FIGS. 12A and 12B that the ring 36 includes a wider central hollow portion 58 and two narrower side hollow portions 60. The size of these hollow portions 58, 60 are such that while the cube-like portion 26 of the engagement member 24 can pass through the central hollow portion 58 but not the side hollow portions 60, the cylindrical portion 28 of the engagement member 24 is of a length l (see FIG. 8) of at least the thickness t of the ring 36 (see FIG. 12B). By way of such an arrangement, when the engagement member 24 is coupled to the ring 36, it can slide relative to the ring 36 in the direction of the arrows A, and can also rotate along its own longitudinal axis. It can thus be seen that it is possible to adjust the distance d between the two pins 22 (see FIG. 11A).

Figure 13A:
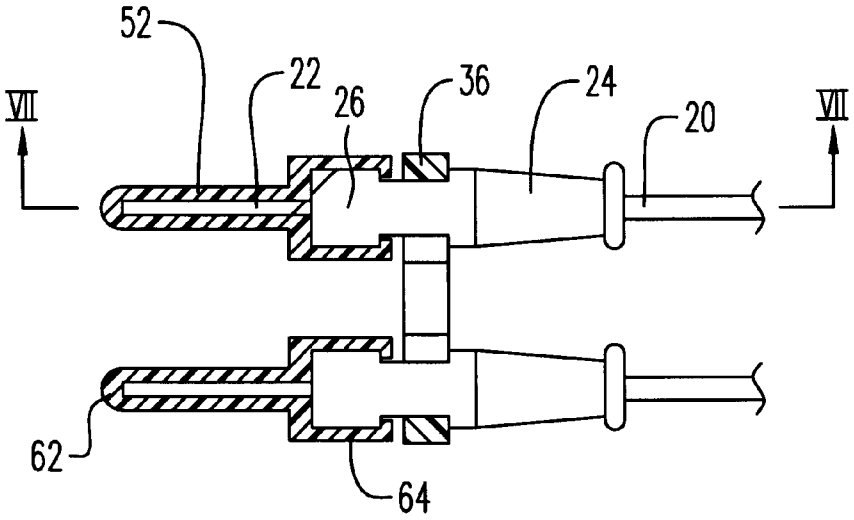
Figure 13B:
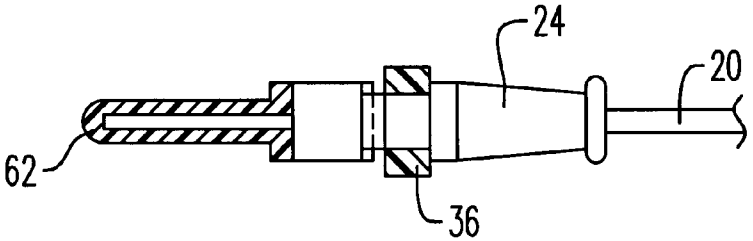
Figure 15A:
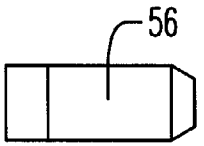
FIG. 15A shows a front view of an earth-hole opener.
Figure 15B:
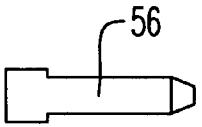
FIG. 15B shows a side view of the earth-hole opener shown in FIG. 15A.

In order to enable the adapter 10 to be plugged into wall sockets of the VDE type, the first type of adapting pins 52 may be engaged with the pin 22 and the cube-like portion 26 of the engagement member 24, as shown in FIGS. 13A and 13B. It can be seen from FIG. 7 that the adapting pin 52 includes a substantially cylindrical part 62 for insertion into a hole of the wall socket and a clip part 64 for engaging the cube-like portion 26. The cylindrical part 62 includes a slit 66 through which the pin 22 extends, so that the pin 22 can be in contact with the electrically-conductive elements in the wall socket.

Figure 14A:
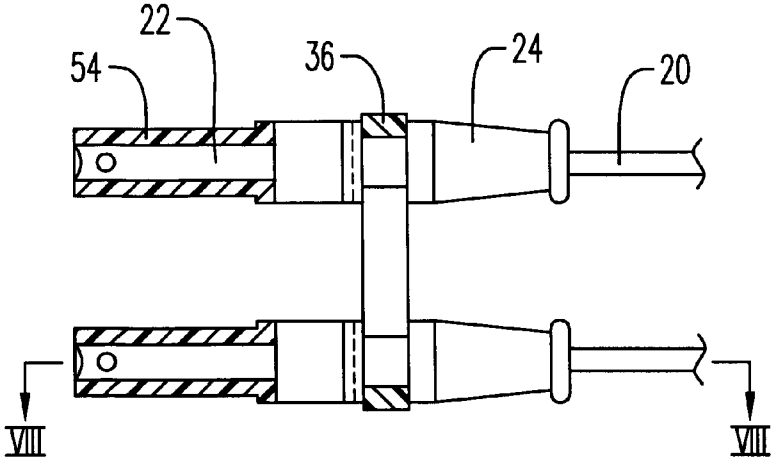
Figure 14B:
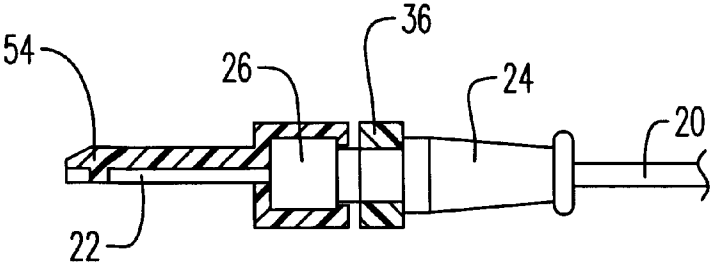

In order to enable the adapter 10 to be plugged into wall sockets of the BS type, the pin 22 may be engaged with the second type of adapting pins 54, as shown in FIGS. 14A and 14B. The adapting pin 54 includes an essentially rectangular prism 68 and a clip part 70. It can be seen in FIG. 14B that when the pin 22 is engaged with the adapting pin 54, a major surface of the pin 22 is exposed so that it may be in contact with the electrically-conductive elements in the wall socket. In this connection, an earth pin 56 is provided which may be used for insertion into the earth hole of the wall socket in order to enable the pins 22 to be inserted into the remaining holes.

Figure 16A:
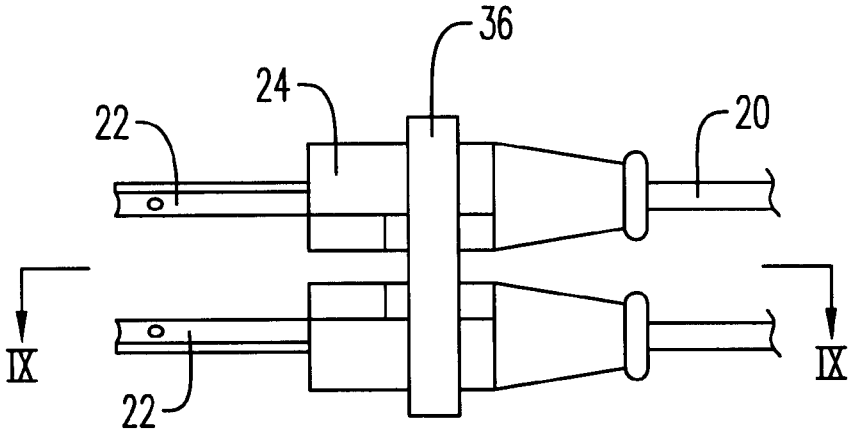
Figure 16B:
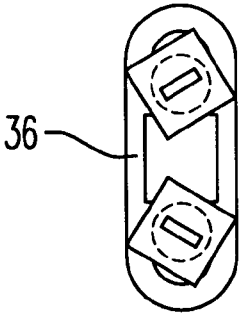
Figure 16C:
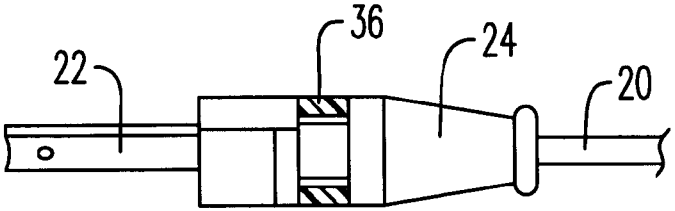

In order to enable the adapter 10 to be plugged into wall sockets of the SAA type, the two engagement members 24 are rotated to the orientation as shown in FIGS. 16A to 16C.

What is claimed is:

1. A universal adapter comprising at least two electrically conductive pin members electrically connected with output socket means of a body member, wherein said pin members are releasably engageable with coupling means for insertion into holes of a wall socket for establishing electrical contact therewith, when said pin members are releasably engaged with said coupling means, said pin members are movable relative to said coupling means to vary the distance between said pin members; and wherein said body member includes securing means for releasably securing said pin members when said pin members are disengaged from the coupling means.

2. An adapter according to claim 1, further comprising at least one said pin member is secured with an engagement member which is releasably engageable with said coupling means.

3. An adapter according to claim 2, wherein each of said at least two pin members is secured with an engagement member which is releasably engageable with said coupling means.

4. An adapter according to claim 2, wherein said pin member is fixedly secured with said engagement member.

5. An adapter according to claim 2, wherein said engagement member includes at least a front portion and an engagement portion wherein said engagement portion is narrower than said front portion.

6. An adapter according to claim 5, wherein said engagement member includes a rear portion which is wider than said engagement portion.

7. An adapter according to claim 5, wherein said engagement portion contacts said coupling means when said engagement member is engaged with said coupling means.

8. An adapter according to claim 1, wherein at least one said pin member is swivellably movable relative to said coupling means when said pin member is releasably engaged therewith.

9. An adapter according to claim 1, at least one said pin member is slidably movable relative to said coupling means when said pin member is releasably engaged therewith.

10. An adapter according to claim 1, wherein when said pin members are releasably engaged with said coupling means, said pin members are movable relative to said coupling means to vary the inclination between major surfaces of said pin members.

11. An adapter according to claim 1, wherein said securing means is provided on a major surface of said body member.

12. An adapter according to claim 1, further including adapting pins releasably engageable with said pin members.

13. An adapter according to claim 12, wherein said adapting pin includes a substantially cylindrical portion for allowing said pin members to be inserted into holes of a circular shape.

14. An adapter according to claim 13, said adapting pin includes a substantially rectangular prism.

15. An adapter according to claim 1, wherein said body member includes two releasably closable cover members.

16. An adapter according to claim 15, wherein said cover members are closable to define an inner cavity.

17. An adapter according to claim 12, wherein said body member includes two cover members which are releasably closable to define an inner cavity.

18. An adapter according to claims 17, wherein said adapting pins are receivable within said inner cavity of said body member.

19. An adapter according to claim 3, wherein said pin member is fixedly secured with said engagement member.

20. An adapter according to claim 3, wherein said engagement member includes at least a front portion and an engagement portion wherein said engagement portion is narrower than said front portion.

21. An adapter according to claim 6, wherein said engagement portion contacts said coupling means when said engagement member is engaged with said coupling means.

* * * * *